US005611984A

United States Patent [19]

Sculler et al.

[11] Patent Number: 5,611,984

[45] Date of Patent: Mar. 18, 1997

[54] METHOD FOR STABILIZING MICROPOROUS MARKING STRUCTURES

[75] Inventors: Steven J. Sculler, Morganville; Arthur A. Tracton, Hillsborough, both of N.J.

[73] Assignee: M&R Marking Systems, Inc., Piscataway, N.J.

[21] Appl. No.: 562,117

[22] Filed: Nov. 22, 1995

[51] Int. Cl.[6] ..... B41K 1/50

[52] U.S. Cl. ..... 264/238; 134/16; 101/333

[58] Field of Search ..... 134/6, 16; 264/321, 264/109, 126, 238; 101/333, 335

[56] References Cited

U.S. PATENT DOCUMENTS

| | | | |
|---|---|---|---|
| 2,777,824 | 1/1957 | Leeds | 521/52 |
| 3,019,201 | 1/1962 | Clancy et al. | 101/335 |
| 3,055,297 | 9/1962 | Leeds | 521/52 |
| 3,613,578 | 10/1971 | Heurich | 101/350 |
| 3,755,517 | 8/1973 | Clancy et al. | 264/41 |
| 3,808,966 | 5/1974 | Busch | 100/106 |
| 3,858,431 | 1/1975 | Miller . | |
| 3,971,315 | 7/1976 | Hansen | 101/333 |
| 4,022,127 | 5/1977 | Carlsson et al. | 101/327 |
| 4,100,853 | 7/1978 | Clancy et al. | 100/401.1 |
| 4,226,911 | 10/1980 | Haren | 428/375 |
| 4,306,498 | 12/1981 | Fujimura | 101/333 |
| 4,615,208 | 10/1986 | Hailey . | |
| 4,717,426 | 1/1988 | Brynildsen | 134/26 |
| 4,735,143 | 4/1988 | Weir | 101/333 |
| 4,824,621 | 4/1989 | Piepmeier, Jr. et al. | 264/41 |
| 4,927,695 | 5/1990 | Ooms et al. | 428/159 |
| 5,006,404 | 4/1991 | Terry | 428/316.6 |
| 5,030,292 | 7/1991 | Koike et al. | 134/6 |
| 5,049,432 | 9/1991 | Ooms et al. | 428/159 |
| 5,111,745 | 5/1992 | Wilson | 101/333 |
| 5,185,111 | 2/1993 | Lazar | 264/49 |
| 5,277,721 | 1/1994 | Ooms | 156/64 |
| 5,292,565 | 3/1994 | Napier et al. | 428/36.5 |
| 5,421,951 | 6/1995 | Troutner et al. . | |

FOREIGN PATENT DOCUMENTS

| | | | |
|---|---|---|---|
| 2461120 | 7/1975 | Germany | 134/6 |

*Primary Examiner*—Allan R. Kuhns

*Attorney, Agent, or Firm*—Lerner, David, Littenberg, Krumholz & Mentlik

[57] ABSTRACT

A method and an apparatus for stabilizing a microporous marking structure is disclosed. The method comprises the steps of placing a microporous marking structure in conjunction with an absorbent material within a stabilizing device. A positive pressure is then applied to the microporous marking structure within the stabilizing device until a sufficient amount of ink originally retained within the microporous marking structure is forced to flow therefrom into the absorbent material so that the microporous marking structure obtains a substantially stabilized state. The apparatus may comprise a pair of substantially rigid plates arranged for relative movement with respect to each other wherein at least one of the substantially rigid plates is adapted to support a microporous marking structure thereon until the microporous marking structure is arranged between the plates. The apparatus also includes a pressure generating device for compressing the microporous marking structure between the pair of rigid plates until a desired amount of ink is removed from the marking structure.

24 Claims, 2 Drawing Sheets

METHOD FOR STABILIZING MICROPOROUS MARKING STRUCTURES

FIELD OF THE INVENTION

The present invention pertains to a method and apparatus for manufacturing microporous marking structures. More particularly, the present invention pertains to a method and apparatus for removing excess ink from microporous marking structures which may be used on hand stamps.

BACKGROUND OF THE INVENTION

Microporous marking structures for use as marking structures on hand stamps may be made of suitable polymeric materials and resin (i.e., thermoplastic resin) or other open cell compositions which combine to form a slab-like structure including a large quantity of microscopic pores. The microporous structure may be impregnated with ink or other suitable marking fluid which fill many of the microscopic pores.

When such microporous marking structures are used as marking structures on hand stamps, they are commercially known as pre-inked hand stamps since they can be used to create thousands of impressions without applying additional ink to the marking structure. This is possible because the microscopic size of the pores allow the ink initially retained therein to escape at a controlled rate.

One brand of high quality pre-inked hand stamps are sold by M&R Marking Systems, Inc. of Piscataway, N.J. under the trademark ROYAL MARK. The pre-inked marking structures are made from ROYAL MARK brand gel which comprises a mixture of thermoplastic resin and ink. This mixture is also known as pre-mix used for manufacturing microporous marking structures.

Various methods of manufacturing such microporous marking structures exist. When microporous marking structures for use with currently available ROYAL MARK pre-inked hand stamps are manufactured, the ROYAL MARK pre-mix is poured into a mold. The mold is then heated in a vulcanizer at a predetermined pressure and temperature for a selected period of time. When this procedure is completed, the marking structure may be removed from the mold as a microporous slab. The manufacturing process is not yet completed at this time as the formed microporous slab retains too much ink to be placed on a hand stamp mount. It is therefore necessary to remove excess ink from the microporous marking structure prior to assembly on an associated mount. The process of removing such excess ink is known as stabilizing the microporous marking structure.

Another known method of manufacturing microporous marking structures contemplates initially forming a microporous structure which does not contain ink. The microporous structure is then impregnated with ink during a separate procedure. As with the aforementioned method of manufacturing microporous marking structures from a pre-mix which comprises thermoplastic resin and ink at the outset, the completed microporous marking structure includes excess ink which must be removed therefrom prior to assembly on an associated mount. Thus, stabilization procedures must be performed with all known methods of manufacturing microporous marking structures for use with pre-inked hand stamps.

Prior art inventors have exerted great effort to accomplish such stabilization. One well known commercially successful method has been employed by M&R Marking Systems. This method requires the placement of the microporous marking structure slab on newspaper, or other absorbent material in an oven where it is heated for a selected period of time. The heat causes the ink retained within the microscopic pores to flow out of the associated slab. This ink is then absorbed by the newspaper on which the marking structure is placed. The marking structure may then be removed from the oven and blotted with paper towel to absorb additional ink which has been caused to flow from the microscopic pores to the surface of the slab. The steps of heating and blotting the microporous slab to remove excess ink therefrom may be repeated several times.

When a desired amount of ink is removed from the microporous marking structure, it is considered to be stabilized and may be assembled on a mount.

Another known system for stabilizing microporous marking structures requires the use of negative pressure and a vacuum table. In accordance with the known negative pressure stabilizing system, a pre-inked microporous marking structure is placed on a vacuum table. Paper towel is then placed adjacent to the marking structure and a flexible plastic sheet is placed on top of the covered marking structure on the table. Vacuum suction is then applied through vacuum ports in the bottom of the table so that a negative pressure environment is created between the top surface of the table and the flexible plastic cover. Excess ink retained within the microscopic pores of the marking structure is extracted within the negative pressure vacuum environment and is absorbed into the paper towels. The negative pressure system does not include a controlled application of pressure and is largely dependent on user controlled parameters. Therefore, there is no control to assure that a consistently stabilized marking structure will be produced.

It is also known in the art to use cooperating rollers to remove excess ink from microporous stamp pads. This arrangement cannot practically be used to stabilize microporous marking structures intended for use with pre-inked hand stamps because it can lead to distortion of characters and does not provide sufficient control.

The present invention overcomes the shortcomings of the prior art by providing a method and apparatus for stabilizing microporous marking structures in a controlled environment wherein the required stabilization is accomplished in a short period of time and with more control than has heretofore been achieved.

SUMMARY AND OBJECTS OF THE INVENTION

In accordance with one aspect of the present invention, an apparatus is provided for stabilizing microporous marking structures. As used herein, the term "stabilizing" means to remove excess ink from microporous marking structures so that the marking structures can be arranged on a mount for use as the marking structure of a hand stamp. The term stabilization is also intended to cover situations where a microporous marking structure is substantially stabilized in that the undesirable excess ink has been removed from a microporous marking structure.

The apparatus preferably comprises first and second substantially rigid plates arranged for relative movement with respect to each other. The first and second substantially rigid plates each include a substantially planar surface which opposes a substantially planar surface of the other plate. One of the substantially planar surfaces is adapted to support a microporous marking structure thereon so that the microporous marking structure can be arranged between the opposing substantially planar surfaces. The apparatus also comprises pressure application means for effecting relative movement of the first and second substantially rigid plates with respect to each other whereby the microporous marking structure placed between the opposing substantially planar surfaces is compressed under a predetermined pressure for a predetermined amount of time.

The substantially planar surfaces may constitute only a portion of the surface of each of the first and second substantially rigid plates. Further, the term "plate" as used herein is intended to cover substantially rigid structures having a surface with various geometric configurations. In a preferred embodiment, the surface of the plates may have a square configuration. In other embodiments, the surface of the plates may have a circular configuration, or any other geometric configuration. The plates should be suitable to compress a microporous marking structure therebetween as will be discussed further below.

In one preferred embodiment, the first and second substantially rigid plates comprise a lower plate and an upper plate. The upper plate may be fixed to a frame and the lower plate may be mounted for movement toward or away from the upper plate. It should be appreciated that in additional preferred embodiments of the present invention, various mounting arrangements of the upper and lower plates may be utilized. For example, the lower plate may be fixed and the upper plate may be movable toward or away from the lower plate. In another preferred embodiment, both the upper and lower plates can be selectively and simultaneously movable toward or away from each other. Further, the rigid plates may not be vertically oriented. To this end, the first and second rigid plates may be mounted for movement along a horizontal axis, or amy other axis. In such embodiments, the present invention will include means for securing a marking structure to one of the rigid plates so that it can be retained in proper position during pressurization thereof.

The pressure application means may comprise pump means for generating a fluid pressure, and a piston assembly operatively connected to the pump means for translating the fluid pressure generated by the pump means into a driving force used to cause relative movement of the first and second substantially rigid plates with respect to each other. It should be appreciated that the term "fluid" is intended to cover both liquid and gaseous fluids.

The pressure application means may also comprise a pressure regulator operatively associated with the pump means for regulating the fluid pressure applied to the piston assembly. Additionally, the pressure application means may comprise timing means for governing the period of time that the microporous marking structure will be compressed between the opposing substantially planar surfaces of the first and second substantially rigid plates.

In a preferred embodiment, the stabilizing apparatus may comprise a frame and one of the substantially rigid plates may be fixed on the frame. The other substantially rigid plate may be mounted on the pressure application means for operative movement toward or away from the fixed substantially rigid plate.

In another preferred embodiment, the pressure application means may comprise a pressure generating source other than a pump. To this end, the pressure generating source may comprise an electrical force generator, or various types of mechanical force generating devices.

In accordance with another aspect of the present invention, a method of stabilizing microporous marking structures is provided. The method may comprise the steps of placing the microporous marking structure on or within an absorbent material. The microporous marking structure and the absorbent material may be arranged within a stabilizing device. A positive pressure is then applied to the microporous marking structure within the stabilizing device until a sufficient amount of ink originally retained within the microporous marking structure has been forced to flow therefrom into the absorbent material so that the microporous marking structure obtains a substantially stabilized state. The substantially stabilized microporous marking structure may then be removed from the stabilizing device. If desired, the microporous marking structure may then be mounted for use as a marking structure of a hand stamp.

In a preferred embodiment, the step of placing the microporous marking structure on or within the absorbent material may comprise arranging the absorbent material on opposing sides of the microporous marking structure. The absorbent material may comprise paper towel or other absorbent material having sufficient absorbency to absorb ink forced to flow from the microporous marking structure.

The method of the present invention may also comprise the step of regulating the application of pressure applied to the microporous marking structure. It is also preferable to apply the regulated pressure for a predetermined period of time after which the applied pressure will automatically be discontinued.

In accordance with a preferred method of stabilizing microporous marking structures, the microporous marking structure and the associated absorbent material may be placed on a rigid plate of a stabilizing device. The microporous marking structure may then be compressed between a pair of rigid plates under a predetermined pressure sufficient to force the ink retained within the microporous marking structure to flow therefrom into the absorbent material so that the microporous marking structure is substantially stabilized. In this preferred embodiment, a controlled driving force may be applied to at least one of the plates so that the microporous marking structure arranged between the pair of rigid plates is subjected to a predetermined pressure.

The predetermined pressure applied to the microporous marking structure may be between about 1.0 and 100 psig. More preferably, the predetermined pressure may be between about 3–20 psig and even more preferably may be between about 4–10 psig. Further, the preselected period of time to which the pressure may be applied is between about 10 seconds and 15 minutes. This time period is more preferably between about 30 seconds and five minutes and even more preferably between about 40 seconds and three minutes. It should be appreciated that the aforementioned pressure and time ranges are examples of preferred ranges and are not intended to be limiting as the present invention may operate outside of the preferred ranges.

The present invention also contemplates a method of manufacturing microporous marking structures, as opposed to merely stabilizing such structures. In accordance with this aspect of the present invention, the method comprises the steps of forming an ink impregnated microporous marking structure prior to performing stabilization steps. The steps of stabilizing microporous marking structures in accordance with this aspect of the present invention have been discussed above.

As used herein, the term "forming a microporous marking structure" comprises any manufacturing steps which are sufficient to obtain a microporous substrate. For example, the microporous marking structure may be formed by using a pre-mix having a predetermined amount of ink therein, using a powder or other material which does not initially contain any marking fluid and thereafter incorporating marking fluid into the formed microporous marking structure, injection molding techniques, etching techniques, and any other technique in which a microporous substrate is formed. Further, it should be appreciated that stabilization of microporous marking structures in accordance with this present invention presupposes that the microporous marking structure has been impregnated with ink. To this end, the ink may be incorporated into the microporous marking structure during initial forming steps, or the microporous marking structure may be impregnated with the ink after it is initially formed.

DETAILED DESCRIPTION OF THE PREFERRED EMBODIMENTS

Figure 1:
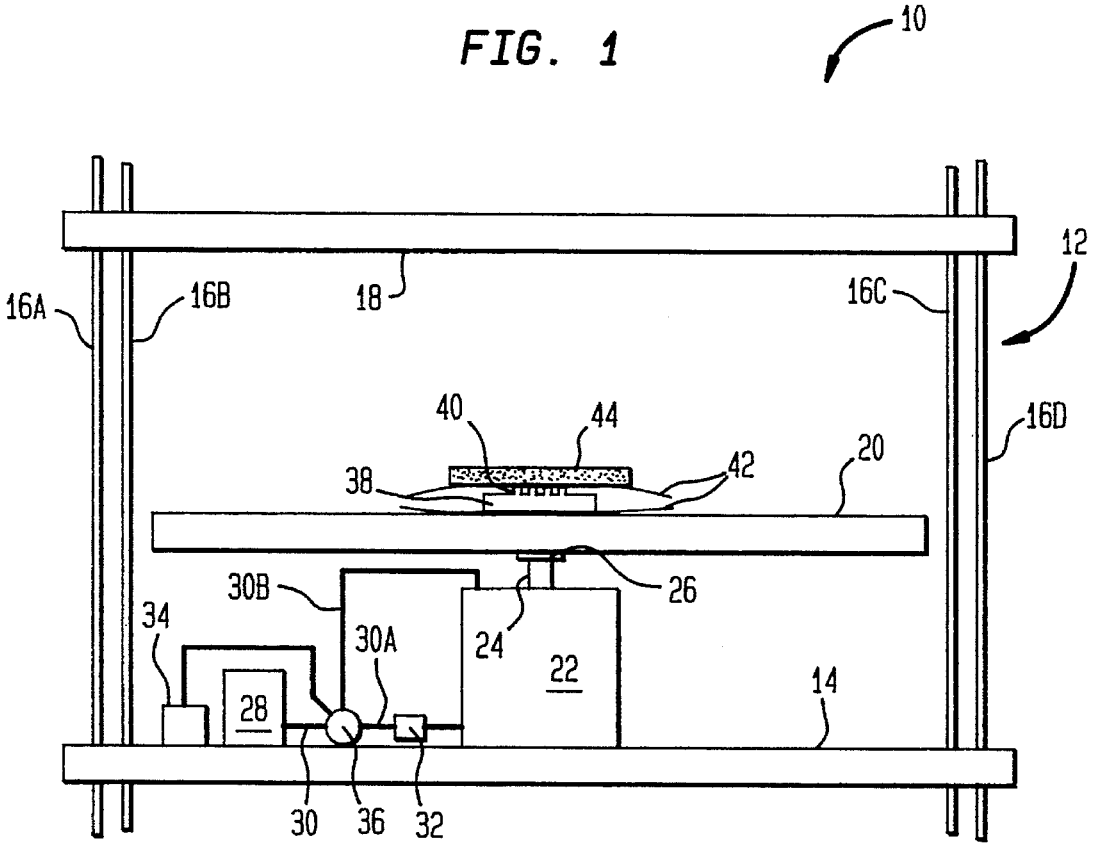
FIG. 1 is a front view of a preferred embodiment of the present apparatus shown in a rest position with a microporous marking structure placed on the surface of one of the rigid plates of the present apparatus prior to stabilization.
Figure 2:
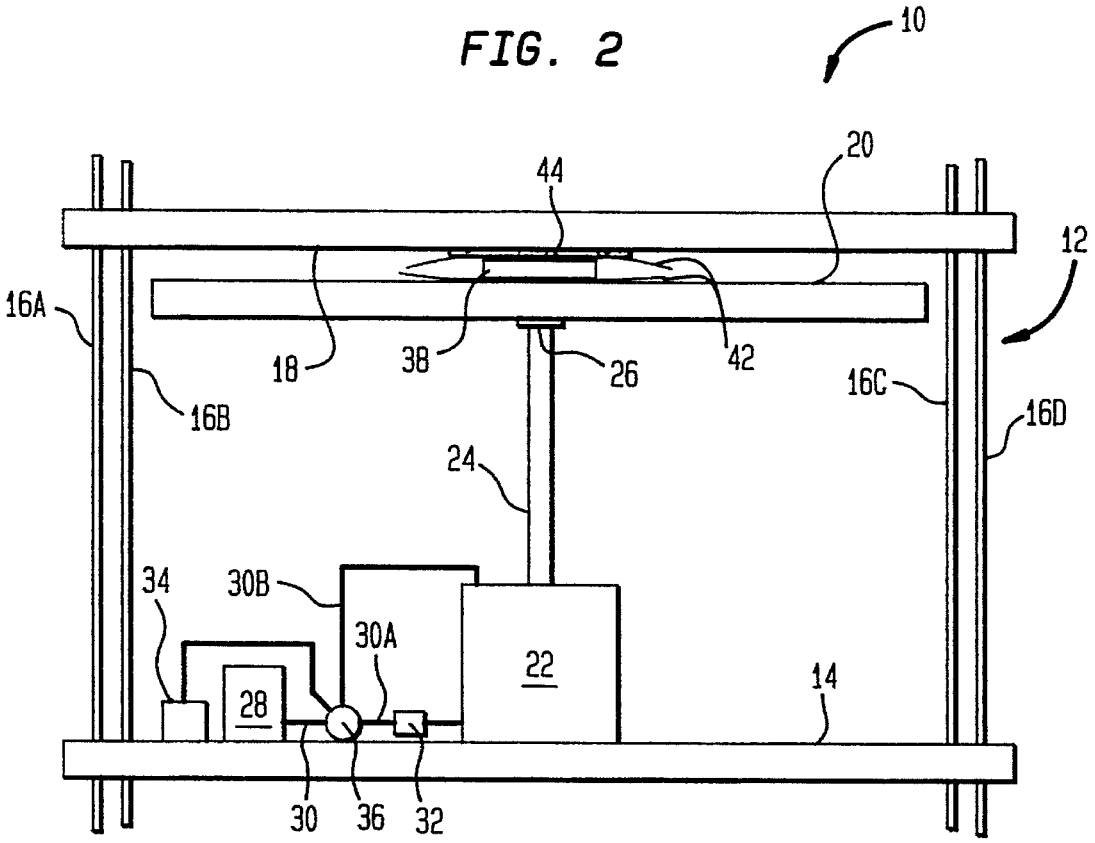
FIG. 2 is a front view of the apparatus shown in FIG. 1 with the microporous marking structure shown in a pressurized state.

An apparatus for stabilizing a microporous marking structure upon application of positive pressure is generally designated 10 in FIGS. 1 and 2. In the preferred embodiment shown in FIGS. 1 and 2, the apparatus 10 includes a frame 12.

The frame 12 includes a base 14 which may be made of various materials suitable for supporting additional parts of the present apparatus 10. In a preferred embodiment, the base 14 may be made of aluminum, steel, polymeric material or other substantially rigid material. The frame 12 also includes four support rods 16A–D which extend upwardly from each corner of the base 14 as illustrated in FIGS. 1 and 2.

An upper pressure plate 18 may be secured to each of the support rods 16A–D by conventional mounting means such as nuts and washers, welds and the like. The upper pressure plate 18 may be made of any suitable substantially rigid material such as aluminum, steel, polymeric materials, cellulose materials, etc.

A movable lower pressure plate 20 is spaced from the upper pressure plate 18 when the apparatus 10 is in a rest position as shown in FIG. 1. FIG. 2 illustrates the apparatus 10 when the upper and lower pressure plates 18 and 20 have been moved to an operative position at which pressure is applied to a marking structure placed therebetween. This feature of the present invention will be discussed below in connection with the method of applying positive pressure to stabilize microporous marking structures.

The lower pressure plate 20 is also made of a substantially rigid material such as aluminum, steel, polymeric materials, cellulose materials, etc. As indicated in FIGS. 1 and 2, the lower pressure plate 20 is secured to a mounting bracket 26 arranged at the top end of the piston rod 24.

The piston rod 24 is movable from a retracted position where it is arranged within pneumatic piston cylinder 22 (as shown in FIG. 1) to an extended position (as shown in FIG. 2). The piston rod 24 may be made of steel, or other rigid material and must have sufficient strength to withstand forces exerted thereon during stabilization of an associated marking structure.

It should be appreciated that although the apparatus 10 of the present invention is described in the preferred embodiments as comprising a pneumatic stabilizing system, other types of positive pressure stabilizing systems can be used within the scope of the present invention. To this end, the stabilizing system may include a hydraulic force generating device, an electrical force generating device or a purely mechanical force generating device.

In accordance with a preferred embodiment, the force generating device may be a pneumatic pump 28 which drives a piston assembly 22 through a plurality of conduits 30, 30A and 30B. Various types of pneumatic pumps may be used. A pneumatic pump having an output of approximately 45 psig has been found to be suitable for use with the apparatus 10.

The conduits 30, 30A and 30B can be made of any suitable material sufficient to transport pressurized fluid to piston assembly 22. Flexible polymeric materials have been found to be suitable. As illustrated in FIGS. 1 and 2, the main conduit 30 is connected between the pneumatic pump 28 and a three way valve 36. A timing device 34 is electrically connected to the valve 36 for precisely controlling the time period that pressure will be exerted upon a microporous marking structure to be stabilized as will be discussed further below.

The valve 36 is adapted to permit fluid pressure to flow from main conduit 30 to branch conduit 30A or branch conduit 30B. Fluid pressure will not be permitted to flow through branch conduits 30A and 30B at the same time. When it is desired to apply pressure to an associated microporous marking structure, the timer 34 will be activated. When the timer 34 is in the on position, the valve 36 will permit pressurized fluid to flow from pneumatic pump 28 through main conduit 30 and into branch conduit 30A. The pressurized fluid flow will be regulated by regulator 32 to assure that it does not exceed a predetermined level. Pressurized fluid will continue to flow through the output end of conduit 30A and into piston assembly 22 whereby the piston rod 24 will be actuated to an extended position as shown in FIG. 2 and discussed below. As will also be discussed below, upon expiration of the pressure application time, the timer 34 will send an electrical signal to valve 36 which in turn will preclude fluid from flowing into branch conduit 30A and will then permit fluid to flow through branch conduit 30B which will actuate piston rod 24 to be returned to a rest position as shown in FIG. 1.

The present method of stabilizing microporous marking structures is entirely novel over prior art methods as it employs positive pressure to achieve such stabilization without subjecting the microporous marking structure to additional heating steps. Further, the present method provides a precisely regulated and timed application of pressure to an associated microporous marking structure so that consistent stabilization results will be achieved.

Figure 3:
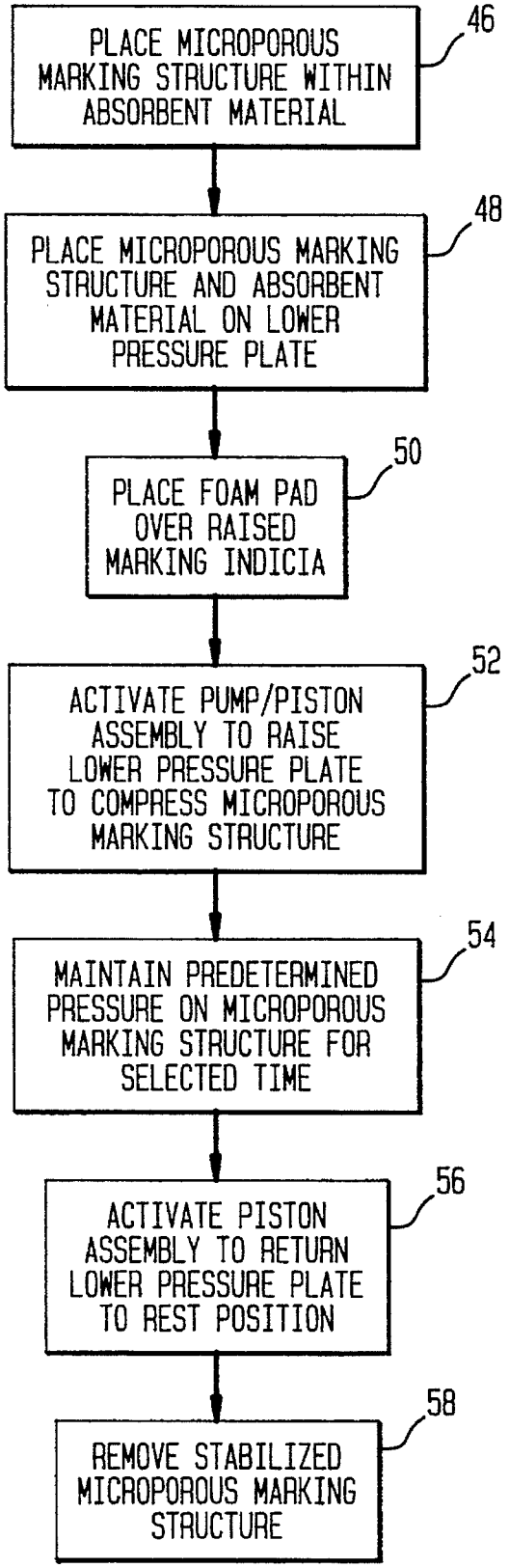
FIG. 3 is a flow diagram illustrating the steps of the present method of applying positive pressure to stabilize a microporous marking structure.

As indicated in FIG. 3 at step 46, the present method initially includes the step of wrapping a microporous marking structure 38 having marking indicia 40 thereon within absorbent material such as paper towel 42. The amount of absorbent material 42 used should be sufficient to absorb excess ink that will be forced to flow out of the microporous marking structure 38 when external pressure is applied thereto. Thus, the required amount of absorbent material 42 will be dependent upon various factors such as the size of the marking structure 38, the pressure applied, the time period of pressure application, the type of ink used, and the composition of the marking structure itself.

As indicated at step 48, the microporous marking structure 38 and the absorbent material 42 are then placed on the top planar surface of the lower pressure plate 20. A foam pad 44 may then be placed over the marking indicia 40 as shown at step 50 to protect the marking indicia from being crushed when pressure is applied to the marking structure 38 during the stabilization process. Various types of foam pads are suitable for protecting the marking indicia 40. In a preferred embodiment, the foam pad 44 will be made of open cell sponge rubber. However, the foam pad may also comprise latex foam. Other resilient materials that are suitable to serve the purpose of protecting the marking indicia 40 from being crushed may be used instead of foam.

At this stage, the marking structure 38 has been appropriately prepared for stabilization. As shown at step 52, the pneumatic pump 28 is then activated so that a driving force is applied to the piston cylinder 22 which will be sufficient to drive the piston rod 24 upward so 0 that the lower pressure plate 20 is moved from its rest position (as shown in FIG. 1) to its operative pressure application position (as shown in FIG. 2). When the lower pressure plate 20 reaches the pressure application position, the microporous marking structure 38 will be compressed between the top surface of the lower pressure plate 20 and the bottom surface of the upper pressure plate 18. Compression of the microporous marking structure 38 will force excess ink retained within the microscopic pores thereof to flow to the surface of the marking structure where the ink will be absorbed by the paper towel 42. The pressure applied to the microporous marking structure 38 will be regulated by the regulator 32 and it will be maintained for a preselected period of time governed by timer 34 as indicated at step 54.

Complete stabilization of the microporous marking structure 38 is a function of various factors such as the pressure applied, the time period of such pressure application, the dimensions of the microporous marking structure, the material that the microporous marking structure is made of, and the type of ink retained within the microporous marking structure. Thus, application of a higher pressure for a relatively short period of time or application of a lower pressure for a relatively long period of time may accomplish stabilization of an associated microporous marking structure.

When a marking structure made of ROYAL MARK pre-ink gel having a width of approximately 8.375 inches, a length of approximately 11.875 inches and a height of approximately 0.25 inches is subjected to a compression force of about 650 lbs., a pressure of about 6.5 psig will be applied thereto. Substantial stabilization of the associated microporous marking structure 38 may be obtained if the aforementioned pressure is maintained for about 60 seconds. If a microporous marking structure having dimensions different than the example set forth above is used, a longer or shorter pressure application time may be required. For example, if stabilization of a marking structure having a width of about 6.375 inches, a length of about 8.375 inches and a height of about 0.25 inches is desired, the same compression force of 650 pounds will generate a pressure of approximately 12.2 psig. Thus, the pressure application time may be reduced in order to achieve stabilization. To further illustrate this point, if a marking structure having a width of approximately 4.625 inches, a length of approximately 6.375 inches and a height of approximately 0.25 inches is selected, a compression force of about 650 pounds will result in a pressure of 22 psig exerted upon the marking structure. Thus, the pressure application period may be reduced even further.

As discussed above, timer 34 may initially be set to permit pressure to be applied to the marking structure 38 for a predetermined period of time. This time control coupled with the regulated pressure controlled by regulator 32 will facilitate the manufacture of high quality consistently stabilized microporous marking structures. After pressure has been applied to the microporous marking structure for the desired period of time, the timer 34 will actuate the valve 36 to divert the flow of pressurized fluid from branch conduit 30A to branch conduit 30B. The pressurized fluid will then be forced to flow into a top chamber of piston assembly 22 so that the piston rod 24 will be forced to return to its retracted position. This will also cause the lower compression plate 20 to be returned to its rest position as indicated at step 56.

At this time, the microporous marking structure 38 should be substantially stabilized and can be removed from the lower pressure plate 20 as indicated at step 58. The absorbent paper towel 42 can be discarded as it may be substantially soaked with the ink that was forced out of the microporous marking structure 38.

It should be appreciated that various modifications to the apparatus of the present invention and the steps of the method of stabilizing microporous marking structures upon application of a positive pressure can be made in the description set forth herein while remaining within the scope of the present application. Indeed, such modifications are encouraged to be made as the scope of the present invention is limited only by the claims set forth below.

What is claimed is:

1. A method of stabilizing microporous marking structures comprising the steps of: placing a microporous marking structure substantially adjacent to an absorbent material; placing the microporous marking structure and the absorbent material on a rigid plate of a stabilizing device; compressing the microporous marking structure between a pair of rigid plates by applying a driving force to at least one of the rigid plates under a predetermined pressure sufficient to force ink retained within the microporous marking structure to flow therefrom into said absorbent material so that the microporous marking structure is substantially stabilized; and removing the substantially stabilized microporous marking structure from its compressed position between the pair of rigid plates.

2. The method of claim 1 wherein said step of placing the microporous marking structure substantially adjacent to an absorbent material comprises arranging the absorbent material on opposing sides of the microporous marking structure.

3. The method of claim 2 wherein said absorbent material comprises paper towel.

4. The method of claim 1 wherein said step of compressing the microporous marking structure between a pair of rigid plates comprises applying a controlled driving force to at least one of the plates so that the microporous marking structure arranged between the pair of plates is subjected to a predetermined pressure for a preselected period of time.

5. The method of claim 1 further comprising the step of placing a resilient member between marking indicia of the microporous marking structure and one of the rigid plates whereby said marking indicia is protected during application of pressure.

6. The method of claim 5 wherein said resilient member comprises a foam composition.

7. The method of claim 1 further comprising the step of regulating the pressure applied to said microporous marking structure until stabilization of the microporous marking structure is obtained.

8. The method of claim 2 further comprising the step of placing a resilient member between marking indicia of the microporous marking structure and at least one of the rigid plates whereby said marking indicia is protected during application of pressure.

9. The method of claim 8 further comprising the step of regulating the pressure applied to said microporous marking structure until stabilization of the microporous marking structure is obtained.

10. A method of stabilizing microporous marking structures comprising the steps of: removing a microporous marking structure from a mold in which it is manufactured; placing the microporous marking structure substantially adjacent to an absorbent material; placing the microporous marking structure and the absorbent material within a stabilizing device; applying a positive pressure to the microporous marking structure within the stabilizing device until a sufficient amount of ink originally retained within said microporous marking structure has been forced to flow therefrom into the absorbent material so that the microporous marking structure obtains a substantially stabilized state; and removing the substantially stabilized microporous marking structure from the stabilizing device.

11. The method of claim 10 wherein said step of placing the microporous marking structure substantially adjacent to absorbent material comprises arranging the absorbent material on opposing sides of the microporous marking structure.

12. The method of claim 11 wherein said absorbent material comprises paper towel.

13. The method of claim 10 further comprising the step of regulating the application of pressure on the microporous marking structure.

14. The method of claim 13 further comprising the step of applying the regulated pressure to the microporous marking structure for a predetermined period of time.

15. The method of claim 14 wherein said applied regulated pressure is automatically removed from the microporous marking structure at the end of said predetermined period of time.

16. A method of manufacturing microporous marking structures comprising the steps of: forming a microporous marking structure impregnated with a marking fluid in a mold; and stabilizing said microporous marking structure by removing the microporous marking structure from the mold and placing the microporous marking structure substantially adjacent to an absorbent material; placing the microporous marking structure and the absorbent material within a stabilizing device; applying a positive pressure to the microporous marking structure within the stabilizing device until a sufficient amount of ink originally retained within said microporous marking structure has been forced to flow therefrom into the absorbent material so that the microporous marking structure obtains a substantially stabilized state; and removing the substantially stabilized microporous marking structure from the stabilizing device.

17. The method of claim 16 wherein said step of placing the microporous marking structure substantially adjacent to absorbent material comprises arranging the absorbent material on opposing sides of the microporous marking structure.

18. The method of claim 16 further comprising the step of regulating the application of pressure on the microporous marking structure.

19. The method of claim 16 further comprising the step of applying the regulated pressure to the microporous marking structure for a predetermined period of time.

20. A method of manufacturing microporous marking structures comprising the steps of: forming a microporous marking structure impregnated with marking fluid; and stabilizing marking structures by placing the microporous marking structure substantially adjacent to an absorbent material; placing the microporous marking structure and the absorbent material on a rigid plate of a stabilizing device; compressing the microporous marking structure between a pair of rigid plates by applying a driving force to at least one of the rigid plates under a predetermined pressure sufficient to force ink retained within the microporous marking structure to flow therefrom into said absorbent material so that the microporous marking structure is substantially stabilized; and removing the substantially stabilized microporous marking structure from its compressed position between the pair of rigid plates.

21. The method of claim 20 wherein said step of placing the microporous marking structure substantially adjacent to an absorbent material comprises arranging the absorbent material on opposing sides of the microporous marking structure.

22. The method of claim 20 wherein said step of compressing the microporous marking structure between a pair of rigid plates comprises applying a controlled driving force to at least one of the plates so that the microporous marking structure arranged between the pair of plates is subjected to a predetermined pressure for a preselected period of time.

23. The method of claim 20 wherein said step of compressing the microporous marking structure between a pair of rigid plates comprises applying a controlled driving force to at least one of the plates so that the microporous marking structure arranged between the pair of plates is subjected to a predetermined pressure for a preselected period of time.

24. The method of claim 20 further comprising the step of regulating the pressure applied to said microporous marking structure until stabilization of the microporous marking structure is obtained.

* * * * *

UNITED STATES PATENT AND TRADEMARK OFFICE
CERTIFICATE OF CORRECTION

PATENT NO. : 5,611,984

DATED : March 18, 1997

INVENTOR(S) : Sculler et al.

It is certified that error appears in the above-identified patent and that said Letters Patent is hereby corrected as shown below:

Column 3, line 33, "amy" should read --any--.

Column 7, line 24, "so 0" should read --so--.

Signed and Sealed this

Twenty-seventh Day of May, 1997

*Attest:*

Bruce Lehman

BRUCE LEHMAN

*Attesting Officer*

*Commissioner of Patents and Trademarks*